US005136304A

United States Patent [19]

Peters

[11] Patent Number: 5,136,304

[45] Date of Patent: Aug. 4, 1992

[54] ELECTRONICALLY TUNABLE PHASED ARRAY ELEMENT

[75] Inventor: Steven J. Peters, Renton, Wash.

[73] Assignee: The Boeing Company, Seattle, Wash.

[21] Appl. No.: 379,817

[22] Filed: Jul. 14, 1989

[51] Int. Cl.[5] ..... H01Q 13/02

[52] U.S. Cl. ..... 343/777; 343/703; 343/786

[58] Field of Search ..... 343/786, 700 MS, 776–778, 343/703

[56] References Cited

U.S. PATENT DOCUMENTS

| | | | |
|---|---|---|---|
| 2,822,541 | 2/1958 | Sichak et al. | 343/783 |
| 3,271,776 | 9/1966 | Hannan | 343/777 |
| 3,508,272 | 4/1970 | Kahn et al. | 343/745 |
| 3,541,557 | 11/1970 | Miley | 343/746 |
| 3,555,553 | 1/1971 | Boyns | 343/786 |
| 3,778,717 | 12/1973 | Okoshi et al. | 343/700 MS |
| 3,825,932 | 7/1974 | Hockham | 343/776 |
| 3,882,396 | 5/1975 | Schneider | 455/ |
| 4,053,895 | 10/1977 | Malagisi | 343/700 MS |
| 4,138,684 | 2/1979 | Kerr | 343/846 |
| 4,157,550 | 6/1979 | Reid et al. | 343/786 |
| 4,200,870 | 4/1980 | Gabbitas | 343/786 |
| 4,251,817 | 2/1981 | Kimura et al. | 343/700 MS |
| 4,412,222 | 10/1983 | Mohring | 343/786 |
| 4,415,900 | 11/1985 | Kaloi | 343/700 MS |
| 4,475,108 | 10/1984 | Moser | 343/830 |
| 4,529,987 | 7/1985 | Bhartia et al. | 343/700 MS |
| 4,605,933 | 8/1986 | Butscher | 343/700 MS |
| 4,724,443 | 2/1988 | Nysen | 343/700 MS |

FOREIGN PATENT DOCUMENTS

| | | | |
|---|---|---|---|
| 3150235 | 6/1983 | Fed. Rep. of Germany | 343/700 MS |

*Primary Examiner*—Michael C. Wimer

*Attorney, Agent, or Firm*—Mary Y. Redman

[57] ABSTRACT

An electronically tunable phased array antenna element compensates for the variation of input impedance as the scan angle of the array changes. A microstrip feed is used which allows monolithic microwave integrated circuits to easily be incorporated in the radiating element housing. The element improves transmit or receive sensitivity. In addition, this electronic tuning will counteract detuning of the element caused by external influences such as electromagnetic field coupling from other nearby antennas.

4 Claims, 6 Drawing Sheets

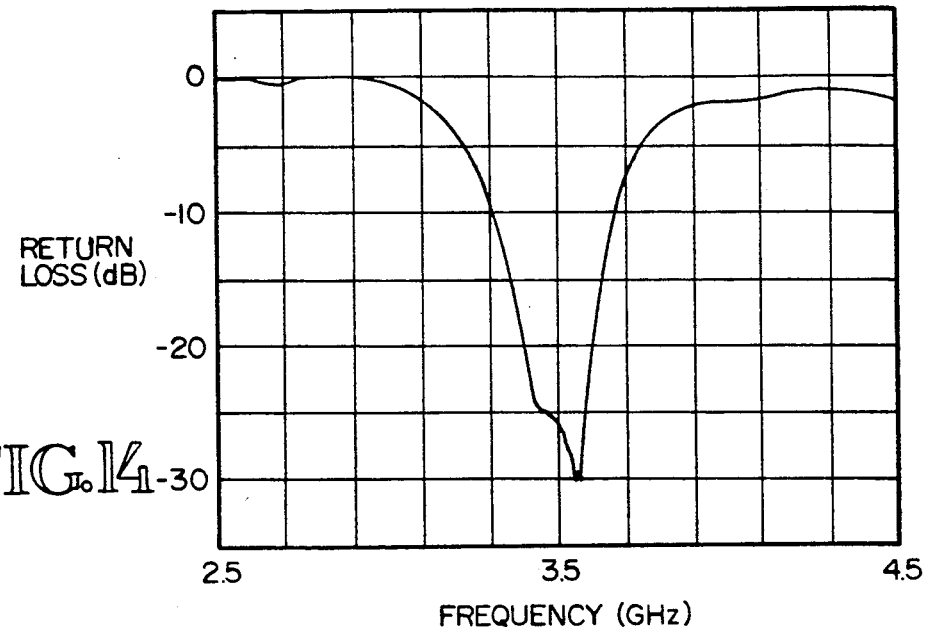
FIG. 14
FIG. 15A
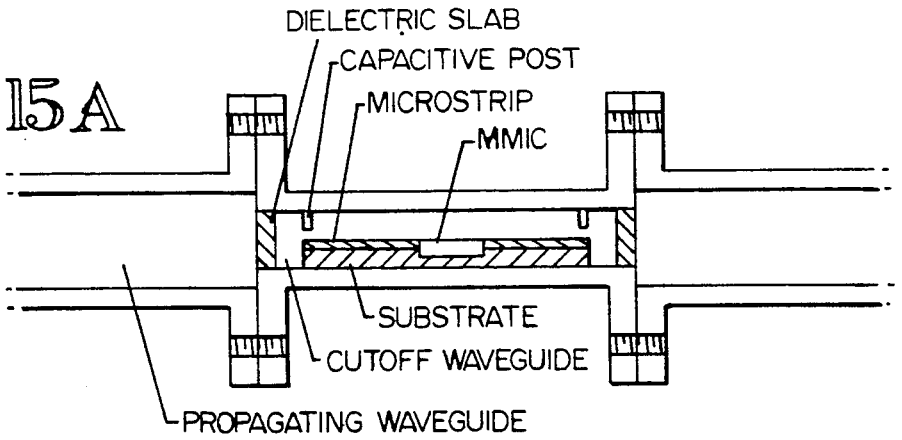
FIG. 15B
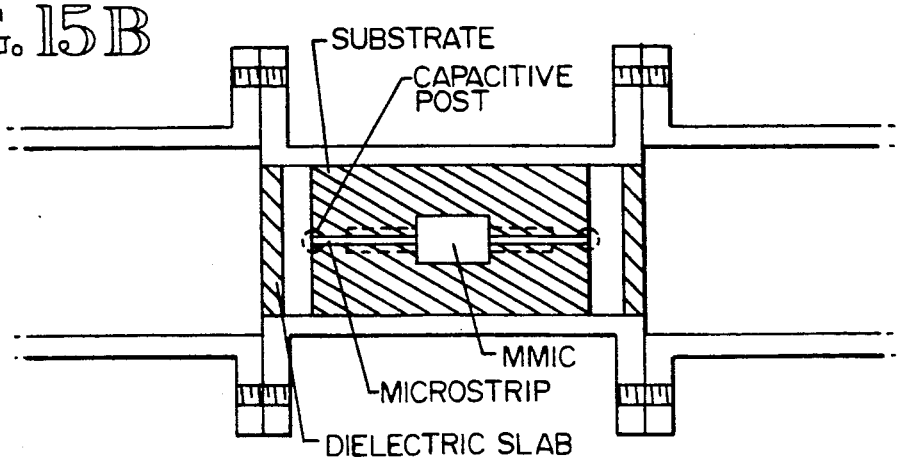

ELECTRONICALLY TUNABLE PHASED ARRAY ELEMENT

FIELD OF THE INVENTION

The invention concerns antennas. More specifically, the invention concerns an antenna element which radiates electromagnetic energy and can be electronically tuned to change its operating frequency. In addition, this electronic tuning will counteract detuning of the element caused by external influences such as electromagnetic field coupling from other nearby antennas.

BACKGROUND OF THE INVENTION

FIG. 1 illustrates a phased array antenna system 10 using a space feed technique to distribute energy to a mulitiplicity of active electronic modules. Each electronic module 11 receives energy from a primary feed 12. The energy is amplified, shifted in phase, and radiated into space. Phase shifters 13, when properly set, cause the phase front to reinforce in a particular direction which, in turn establishes a beam-pointing direction.

One problem with phased array antennas is the reduction of array performance due to the effects of mutual electromagnetic coupling between radiating elements of the array. This coupling, which is frequency dependent and a strong function of scan angle of the phased array, causes an imperfect impedance match at the feed points of each radiating element in the array. This results in increased side lobe levels, degradation of the beam shape produced by a phased array antenna, deterioration of polarization characteristics, and increased heating due to a reduction of antenna efficiency. Under severe conditions, such mutual coupling can also lead to scan blindness in phased array antennas. Scan blindness occurs when a phased array beam is steered to a specific angle, and the elements of the array have a large impedance mismatch with their feed circuits. This results in little or no power being transmitted, such that the array is "blind" at that specific angle.

A device is needed for reducing or eliminating these effects to maximize the performance of a phased array antenna.

SUMMARY OF THE INVENTION

The invention concerns an apparatus comprising an antenna element. The antenna element comprises a waveguide, a means for feeding energy into the waveguide, and a means for physically tuning the waveguide. The antenna element also comprises a means for electronically tuning the waveguide according to the pointing direction of the antenna element. A phased array of such antenna elements, for instance, compensates for the variation of input impedance as the scan angle of the array changes. The antenna elements improve transmit or receive sensitivity and the electronic tuning counteracts detuning of the element caused by external influences such as electromagnetic field coupling from other nearby antennas.

BRIEF DESCRIPTION OF THE FIGURES

FIG. 14 illustrates measured return loss for an evanescent mode radiator including a microstrip transformer.

FIGS. 15A and 15B illustrate an evanescent mode in-line MMIC package.

DETAILED DESCRIPTION OF THE INVENTION

Figure 1:
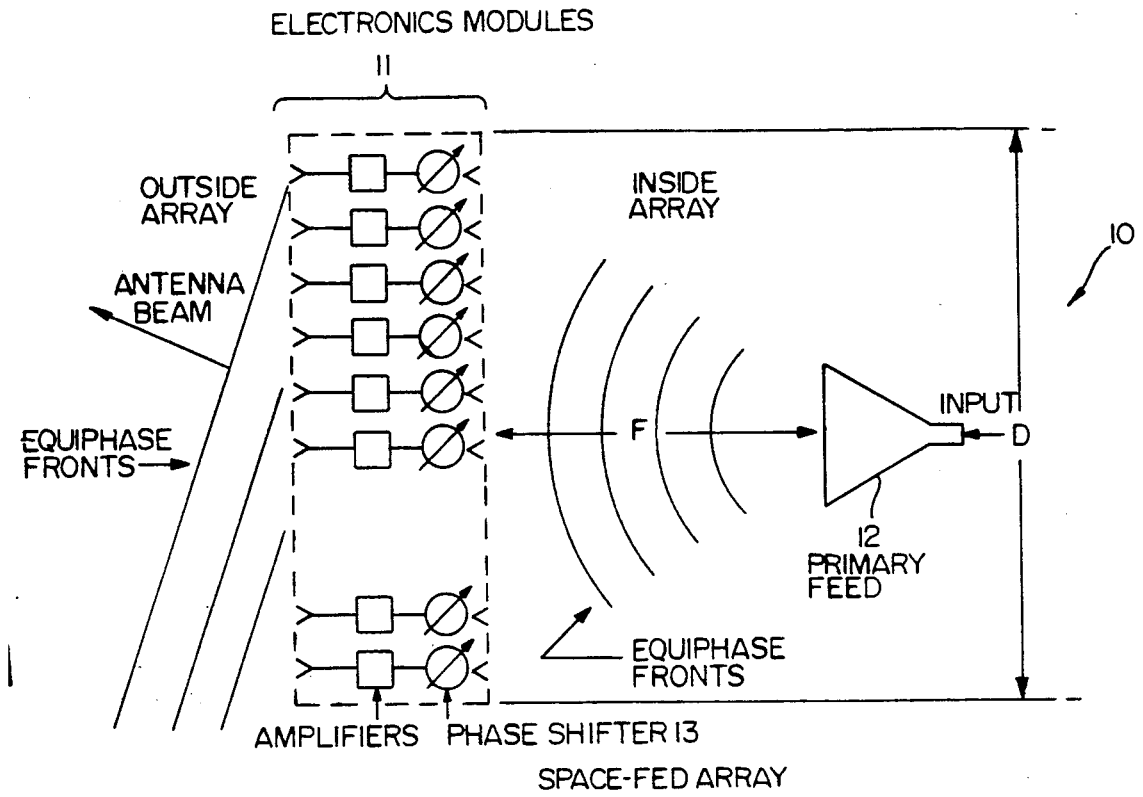
FIG. 1 PRIOR ART
FIG. 1 illustrates a prior art, space fed, phased array antenna.
Figure 2:
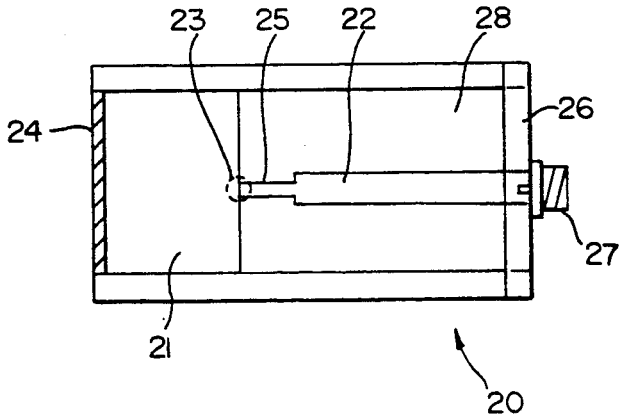
FIGS. 2 and 11 are diagrams of tunable evanescent mode radiators according to this invention.

FIG. 2 shows a top view of an evanescent mode radiator 20 according to this invention, which replaces the antenna element of FIG. 1, for instance. The evanescent mode radiator comprises a short waveguide 21 having a length that is beyond cutoff and therefore has a width less than ½ wavelength, allowing small element spacings to be used. A microstrip feed 22 is coupled to the waveguide 21 by a capacitive post 23. An input launch mechanism comprises capacitive coupling between the end of the microstrip feed 22 and the capacitive post 23, such that currents are excited along this post. These currents in turn generate electromagnetic fields which are "launched" into the waveguide 21. The waveguide 21 has a dielectric slab 24 comprising a shunt capacitance in the radiating end of the waveguide 21.

A microstrip one-quarter wavelength transformer 25 between the microstrip feed 22, and the capacitive post 23 allows less precise electronic tuning and relaxed manufacturing tolerances. A dielectric substrate 28 supports the microstrip feed 22 and the one-quarter wavelength transformer 25. The evanescent mode radiator 20 also comprises a connector flange 26 and a coaxial connector 27 at the non-radiating end of the waveguide 21. The microstrip line can be fed in any number of different ways, rather than just via coaxial connector.

Coupling from the microstrip feed 22 to free space through the waveguide 21 only occurs over a particular bandwidth. This bandwidth is determined by the component dimensions and values used in the device design. Outside of this frequency band and below the cutoff frequency the waveguide presents a short circuit to incoming waves. Therefore, an array of such radiators has a radar cross section (RCS) approaching that of a smooth surface. This eliminates the need for a frequency selective surface that typically covers the front of a phased array on high performance aircraft, for instance.

Figure 3:
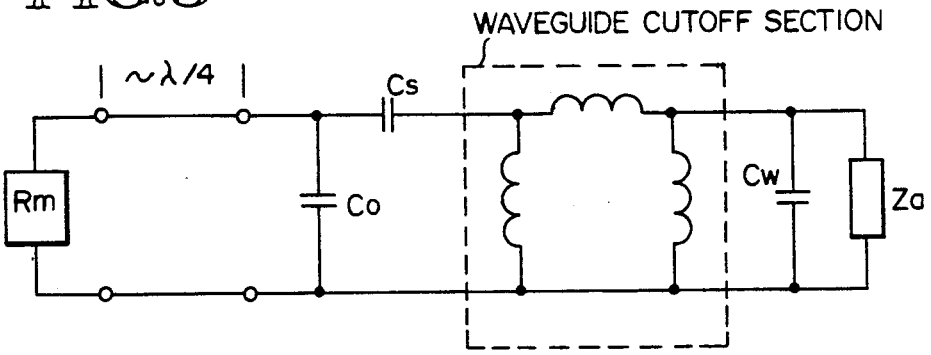
FIG. 3 shows an equivalent circuit for the radiator of FIG. 2.

FIG. 3 shows an equivalent circuit for the evanescent mode radiator 20 of FIG. 2. The evanescent mode radiator 20 is essentially an impedance matching network between a feed circuit and free space. The waveguide section is beyond cutoff. Under this condition a lumped element model for the waveguide is quite accurate as described by G. Craven in, "Waveguide Below Cutoff: A New Type of Microwave Integrated Circuit," Microwave Journal, pp. 51–58, August, 1971.

A matching network is formed by placing a shunt capacitance across the output and an equivalent shunt capacitance across the input, forming a pi network, or three element matching network.

Output shunt capacitance Cw is formed by the dielectric slab 24 at the end of the waveguide 21 of FIG. 2. An impedance Za of the waveguide radiating aperture is in parallel with the shunt capacitance CW. The microstrip feed 22, which has a characteristic impedance Rm, is in series with a microstrip transformer 25, which is approximately $\lambda/4$ long. There is a shunt fringing capacitance Co at the end of the microstrip transformer 22. An equivalent input shunt capacitance is a combination of the fringing capacitance at the end of the microstrip transformer 25 and capacitive post 23. A tuning screw can be used for the capacitive post which provides capacitance Cs and appears in series with the end of the microstrip transformer and connects to the pi network.

Inductive reactance values for the cutoff waveguide are a function of the waveguide width, length, and frequency. The shunt capacitors are chosen such that, in combination with the shunt inductors of the cutoff guide and the load and source impedance, a good impendance match between the source and the load is obtained. The load impedance is the radiation impedance of the waveguide aperture.

Accordingly, many component dimensions and values can be used to build the evanescent mode radiator of FIG. 2, allowing considerable latitude in the device design. For this reason, there is no strict design procedure.

Only the length of waveguide beyond the end of the microstrip feed in FIG. 2 is used in the matching circuit. The rest of the waveguide provides a housing for the microstrip feed. Therefore, the actual length of waveguide needed to build a radiator is very short (on the order of $\frac{1}{8}$ of a wavelength).

Figure 4:
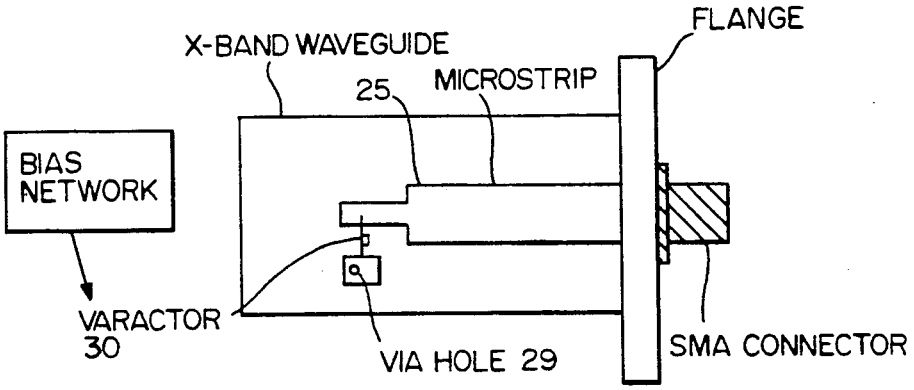
FIGS. 4 and 6 illustrate the tuning of evanescent mode radiators according to this invention.
Figure 6:
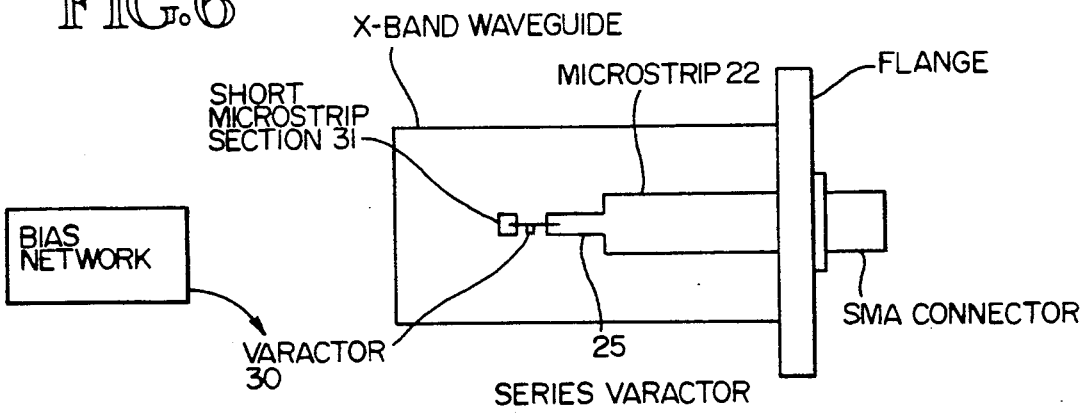

The evanescent mode radiator of FIG. 2 is electronically tuned according to this invention by changing the equivalent capacitance at the input of the waveguide 21. This is done electronically using a varactor. The varactor can be either placed in shunt to ground from the end of the microstrip feed or placed in series with the microstrip feed and a short microstrip section. FIGS. 4 and 6 respectively show these two placements of varactors.

For the shunt configuration of FIG. 4, a via hole 29 is used to connect the varactor 30 to ground. The via hole 29 has a small inductance which appears in series with the varactor 30. The capacitive post extends down from the top of the waveguide 21 to the microstrip feed 22. A bias network controls the bias of the varactor 30. In a phased array this biasing can be controlled as described concerning FIGS. 8 and 9.

Figure 5:
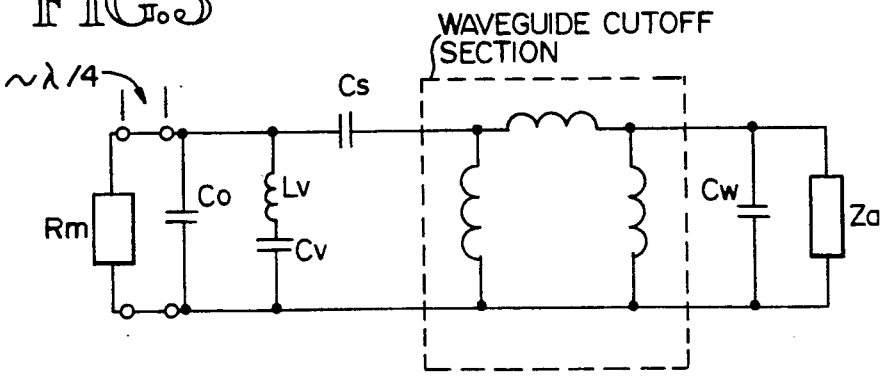
FIGS. 5 and 7 show equivalent circuits for the radiators of FIGS. 4 and 6.

FIG. 5 shows an equivalent circuit for a shunt varactor tuned evanescent mode radiator corresponding to the apparatus of FIG. 4. A wave-guide cut-off section is modeled by a pi network. A shunt capacitance Cw is formed by the dielectric plate at the end of the waveguide. An impedance Za of the waveguide radiating aperture is in shunt with the capacitance Cw. A quarter wave microstrip transformer is in series between the microstrip feed line, having a characteristic impedance Rm, and a fringing capacitance Co. A capacitance Cs, due to the end of the post, appears in series with the end of the microstrip transformer and connects to the pi network. A via hole inductance Lv and a varactor capacitance Cv, connected in series, are parallel to the fringing capacitance Co.

For the series configuration of FIG. 6, a short microstrip section 31 enables capacitive coupling to the capacitive post 23, which extends down from the top of the waveguide 21. Capacitance is adjusted as required to obtain a good match between the microstrip feed 22 and free space by varying the bias on the varactor 30. A bias network controls the bias of the varactor 30. In a phased array this biasing can be done as described concerning FIGS. 8 and 9.

Figure 7:
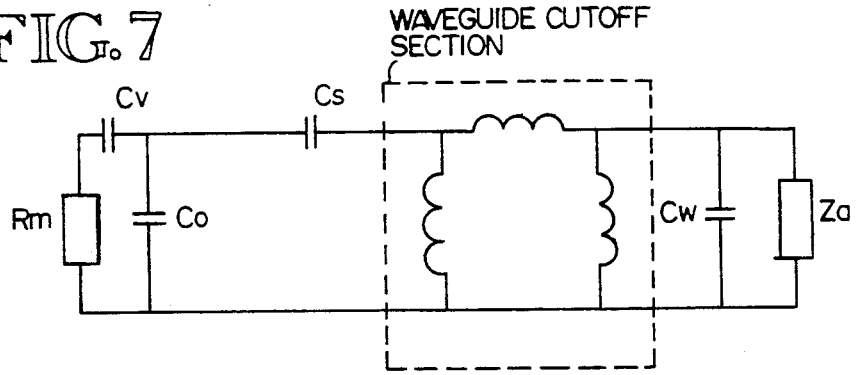

FIG. 7 shows an equivalent circuit of a series varactor tuned evanescent mode radiator corresponding to the apparatus of FIG. 6. A wave-guide cut-off section is modeled by a pi network. A shunt capacitance Cw is formed by the dielectric slab 24 at the end of the waveguide 21. An impedance Za of the waveguide radiating aperture is in parallel with the shunt capacitance. A quarter wave microstrip transformer is placed between the microstrip feed, which has a characteristic impedance of Rm, and a parallel fringing capacitance Co at the end of the microstrip transformer. A capacitance Cs due to the post in the waveguide, appears in series and connects to the pi network. A varactor capacitance Cv is in series with the microstrip feed.

When this evanescent mode radiator is used in a phased array, a bias control network can be used to vary the bias on the varactor. The amount of bias is determined according to two approaches.

Figure 8:
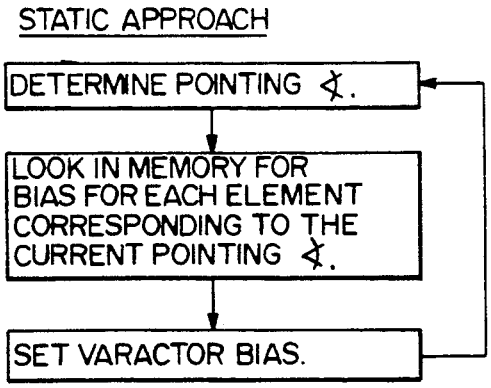
FIGS. 8 and 9 illustrate approaches for biasing evanescent mode radiators in a phased array according to this invention.

FIG. 8 is a flow chart illustrating a static approach for determining varactor bias. First, the pointing angle of the tunable element is determined. Next, a memory is examined for the correct bias of each element that corresponds to the current pointing angle. This memory can comprise a look-up table in a computer, for example. Next, the varactor bias is directly set, and the next pointing angle is determined. In this manner, as pointing angle changes, varactor bias similiarly changes.

Figure 9:
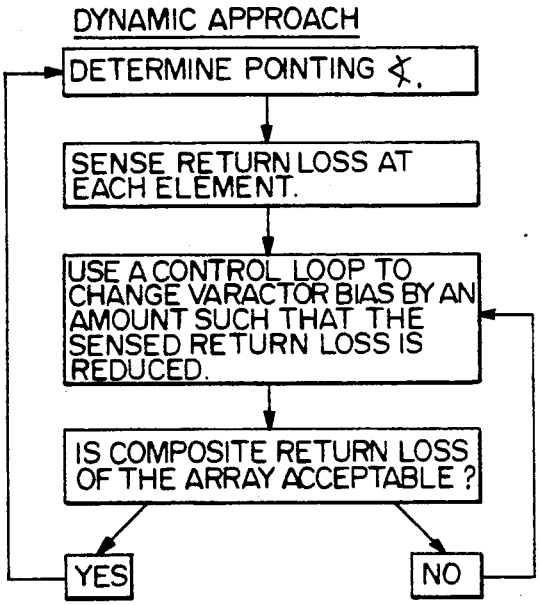

FIG. 9 is a flow chart illustrating a dynamic approach. First, the pointing angle of an element is determined. Next, return loss is sensed for each element. Next, a control loop changes the varactor bias by an amount that reduces sensed return loss. Next, in light of predetermined design constraints, a determination is made if composite return loss of the array is acceptable. If return loss is not acceptable, the varactor bias is again changed until return loss is reduced. However, if the return loss is acceptable, the next pointing angle can be updated.

Figure 10:
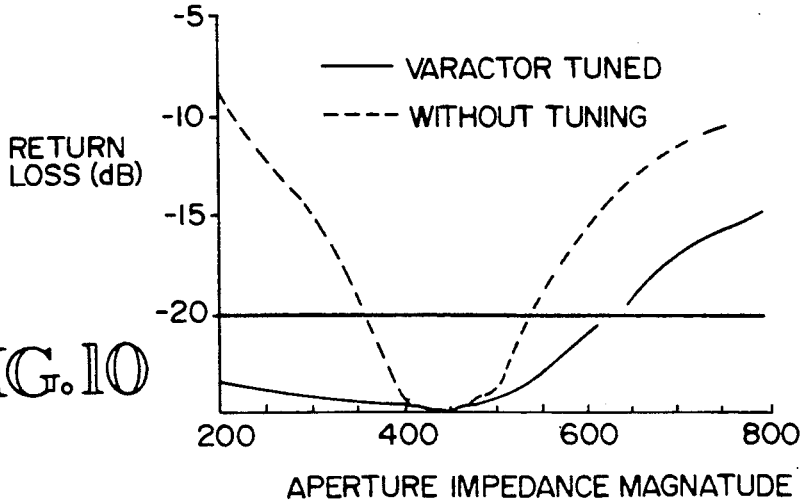
FIG. 10 illustrates a computer simulation of radiator return loss versus aperture impedance.

FIG. 10 illustrates radiator return loss versus the magnitude of aperture impedance for a series-varactor tuned evanescent mode radiator, such as that of FIG. 6. The plots of FIG. 10 were obtained using a lumped circuit model for the radiator. The solid line corresponds to the return loss obtained using a shunt varactor which has been appropriately tune. The dashed line corresponds to the return loss obtained without tuning. A significant reduction in return loss is obtained by tuning the varactor. In FIG. 10 the return loss seen by the microstrip feed is plotted as a function of the aperture impedance, which is Za of FIGS. 5 and 7. The return loss is a measure of how much power is reflected back at the input, where a return loss of −20 dB is considered a good result. The dashed line shows the return loss for an evanescent mode radiator without tuning. As can be seen the return loss for this case varies from about −7 dB to about −25 dB as the load impedance is varied. For the case with tuning, however, the return loss varies from about −15 dB to −25 dB. This shows a significant improvement in performance when tuning is used. Thus a wide range of aperture impedances can be compensated for by proper tuning.

Figure 11:
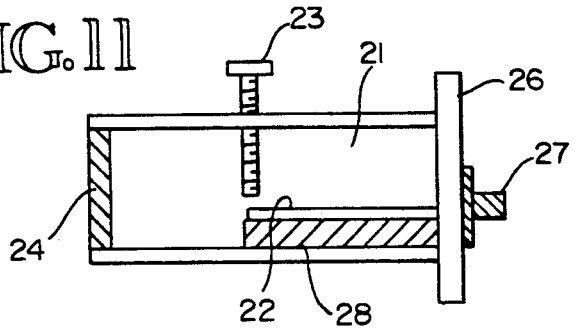

FIG. 11 shows an evanescent mode radiator 20 comprising a section of x-band waveguide 21, which has been built as one example following the general procedure discussed below. The waveguide 21 is 0.886" wide and 0.374" high. The center of the capacitive post 23 is 0.354" from the aperture of the waveguide 21. The dielectric slab 24 at the aperture waveguide is 25 mils thick and has a relative permittivity of 6.0. The dielectric substrate 28 is 62 mils thick and has a relative permittivity of 2.22.

The general procedure follows for building an evanescent mode radiator, such as that of FIG. 11:

A length of waveguide is chosen beyond cutoff to match the microstrip characteristic impedance to the aperture impedance. This matching is based on the pi network component values required to make such a matching network. A discussion of such matching networks is described in H. H. Skilling, *Electric Transmission Lines,* McGraw-Hill, New York 1951, for example.

A dielectric slab thickness is chosen which is thin compared to the wavelength in free space and has a relative permittivity large enough to make the waveguide propagate. When the waveguide is used farther below cutoff, a greater dielectric loading is generally required. From this the aperture impedance can be calculated. One technique for calculating such an impedance is described by Celvin T. Swift, in "Admittance of a Waveguide-Fed Aperture Loaded with a Dielectric Plug", *IEEE Transactions on Antennas and Propagation,* May 1969, for example.

A capacitive post is chosen with a diameter at least as large as the microstrip width. The gap between the bottom of the post and the microstrip is best determined empirically by using a capacitive post in the form of a tuning screw.

The tuning screw is adjusted as necessary to obtain radiation at the required frequency. Fine tuning can be accomplished electronically. The center frequency of the radiator can be electronically tuned to compensate for mutual coupling effects which vary with scan angle.

Figure 12:
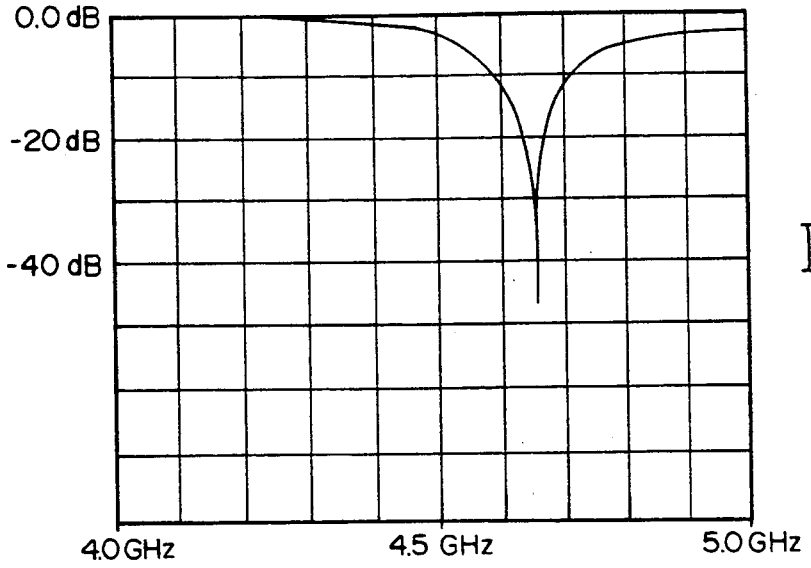
FIGS. 12 and 13 illustrate return loss for evanescent mode radiators.

FIG. 12 illustrates the measured return loss for the evanescent mode radiator 20 of FIG. 11. The cutoff frequency for this waveguide 21 is 6.3 GHz and the frequency of operation is 4.66 GHz. The bandwidth for a 2:1 voltage standing wave ratio (VSWR) is 3%. This provides approximately 120 MHz of bandwidth at the operating frequency. Calculated bandwidth including the one-quarter wavelength transformer is greater than 30%.

Figure 13:
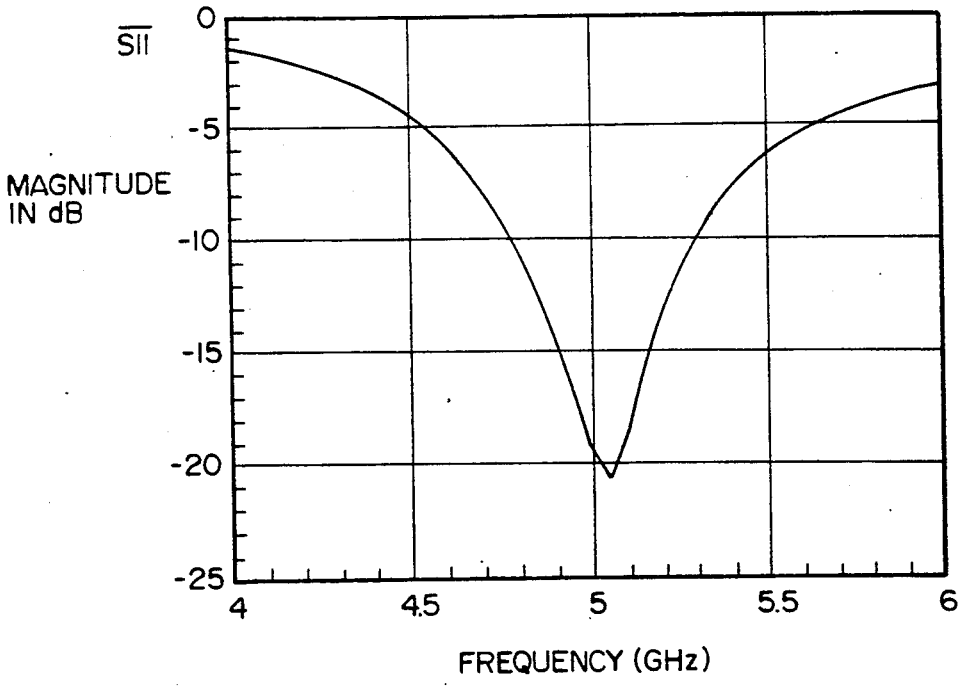

The inventor has also run a computer simulation for an evanescent mode radiator having dimensions similar to that of FIG. 11, but without a one-quarter wavelength transformer. The dielectric slab thickness and capacitance of the post were optimized for maximum bandwidth at 5 GHz for the computer simulation. FIG. 13 illustrates the calculated return loss for this simulation. The center frequency obtained is 5.05 GHz and the band width for a 2:1 VSWR is 10%.

FIGS. 12 and 13 indicate that a significant bandwidth improvement can be achieved by careful choice of radiator components. Typical radar and communication systems, for which this radiator has applications, require 50 MHz to 500 MHz bandwidth. At 5 GHz this is a bandwidth range of 1 to 10%. The required percentage bandwidth becomes substantially smaller at millimeter wave frequencies.

FIG. 14 illustrates the measured return loss for an evanescent mode radiator which included a $\lambda/4$ microstrip transformer in the feed network. This radiator has a center frequency of 3.5 GHz. The cutoff frequency of the waveguide 21 is 6.3 GHz. The bandwidth for a 2:1 VSWR is 11%.

A tunable evanescent mode radiator for use as a phased array antenna element has been described. This element is also a viable packaging approach for monolithic microwave integrated circuit (MMIC) transmit or receive modules, because it provides a reliable nonconductive coupling path between the MMIC and the radiator and the radiator housing provides a self contained MMIC package. Since the waveguide 21 is beyond cutoff, there will be no electromagnetic interference between the MMIC and the energy launched into the waveguide.

The cross sectional shape of the waveguide can be chosen to achieve a particular element radiation pattern. If an oscillator is included in the package, the only inputs needed are bias and control lines. Microcircuitry can be included inside the radiator housing to perform these functions.

FIG. 15A and 15B illustrate an evanescent mode inline monolithic microwave integrated circuit (MMIC) package. FIG. 15A is a side view and FIG. 15B is a top view of the package. In this embodiment, two evanescent mode radiators are used to connect to the input and output of a MMIC. Instead of radiating into free space, however, they radiate into propagating waveguides. Such a package can be used for hybrid microwave circuits as well. Also, while either the input or the output end of the MMIC can use an evanescent radiator to radiate into free space, a propagating waveguide, or some other suitable medium, the opposite end of the MMIC can be connected to a microstrip or coaxial transmission line or other suitable transmission or feed system.

I claim:

1. An apparatus comprising:

an array of antenna elements, the array having a beam pointing direction and each one of said antenna elements comprising a waveguide;

a means for feeding an energy signal into the waveguide, said feeding means comprising a microstrip feed connected to the waveguide;

a means for physically tuning the waveguide to the means for feeding the energy signal, the means for physically tuning comprising a capacitive post; and a means responsive to the energy signal for electronically tuning the waveguide to the means for feeding the energy signal, the means for electronically tuning comprising a varactor connected in series with the microstrip feed;

a means for changing the varactor bias corresponding to each antenna element of the array; and a means for setting a bias of each varactor according to the beam pointing direction of the array.

2. The apparatus of claim 1, comprising a via hole in the waveguide and an electrical ground of the waveguide, the via hole connecting the varactor to the electrical ground.

3. An apparatus comprising:

an array of antenna elements, the array having a beam pointing direction, each of said antenna elements comprising a waveguide configured so as to be operable in the evanescent mode;

a means for feeding an energy signal into the waveguide, said means for feeding an energy signal comprising a microstrip feed connected to the waveguide;

a means for physically tuning the waveguide to the means for feeding the energy signal, the means for physically tuning comprising a capacitive post; and a means responsive to the energy signal for electronically tuning the waveguide to the means for feeding the energy signal, the means for electronically tuning comprising a means for changing capacitance at the means for feeding an energy signal, said means for changing capacitance comprising a varactor connected to the microstrip feed, the varactor connected in series with the capacitive post, and a means for sensing return loss of the antenna element and for adjusting bias of the varactor to reduce return loss, wherein said antenna element is electronically tuned according to the beam pointing direction of the array.

4. The apparatus of claim 3, comprising a via hole in the waveguide and an electrical ground of the waveguide, the via hole connecting the varactor to the electrical ground.

* * * * *